US011074862B2

(12) United States Patent
Bae et al.

(10) Patent No.: US 11,074,862 B2
(45) Date of Patent: Jul. 27, 2021

(54) ORGANIC LIGHT EMITTING DIODE DISPLAY DEVICE AND DRIVING METHOD THEREOF

(71) Applicant: Samsung Display Co., Ltd., Yongin-si (KR)

(72) Inventors: Woo Mi Bae, Daegu (KR); Dae-Gwang Jang, Cheonan-si (KR); Young-Soo Hwang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/853,185

(22) Filed: Apr. 20, 2020

(65) Prior Publication Data

US 2021/0056899 A1 Feb. 25, 2021

(30) Foreign Application Priority Data

Aug. 21, 2019 (KR) ..... 10-2019-0102305

(51) Int. Cl.
*G09G 3/3233* (2016.01)

(52) U.S. Cl.
CPC ..... *G09G 3/3233* (2013.01); *G09G 2320/029* (2013.01); *G09G 2360/144* (2013.01)

(58) Field of Classification Search
None
See application file for complete search history.

(56) References Cited

U.S. PATENT DOCUMENTS

2005/0052350 A1* 3/2005 Mizukoshi ..... G09G 3/3233 345/55
2007/0229398 A1* 10/2007 Oh ..... G09G 3/20 345/44
2009/0237381 A1* 9/2009 Otani ..... G09G 3/3648 345/207
2013/0201223 A1* 8/2013 Li ..... G09G 3/3225 345/690

FOREIGN PATENT DOCUMENTS

KR 10-0824855 B1 4/2008
KR 10-2008-0040845 A 5/2008
KR 10-2009-0034825 A 4/2009
KR 10-1405142 B1 6/2014
KR 10-2018-0050083 A 5/2018

* cited by examiner

*Primary Examiner* — Dorothy Harris
(74) *Attorney, Agent, or Firm* — Lewis Roca Rothgerber Christie LLP

(57) ABSTRACT

An organic light emitting diode display device includes: a display area including a plurality of pixels; a compensation circuit configured to receive a current flowing through the plurality of pixels through a plurality of receiving lines connected to the plurality of pixels, and to generate a compensation value to compensate for deterioration of a driving transistor in each of the plurality of pixels based on the received current; a photo-sensor configured to measure external light to generate a light sensing signal; and a signal controller configured to cause the compensation circuit to generate the compensation value when no external light is incident on the photo-sensor such that the light sensing signal is received at a first voltage level and to perform external compensation to generate an image data signal by applying the compensation value to an image signal received from an external device.

20 Claims, 10 Drawing Sheets

ORGANIC LIGHT EMITTING DIODE DISPLAY DEVICE AND DRIVING METHOD THEREOF

CROSS-REFERENCE TO RELATED APPLICATION

This application claims priority to and the benefit of Korean Patent Application No. 10-2019-0102305 filed on Aug. 21, 2019 in the Korean Intellectual Property Office (KIPO), the entire content of which is incorporated herein by reference.

BACKGROUND

1. Field

Embodiments of the present disclosure relate to an organic light emitting diode display device and a driving method thereof. More particularly, the present disclosure relates to an organic light emitting diode display device including a photo-sensor and a driving method thereof.

2. Description of the Related Art

In recent years, an organic light emitting diode display device has attracted attention as a device for displaying an image.

Because the organic light emitting diode display device, unlike a liquid crystal display device, has a self-emission characteristic and does not require an additional light source it is possible to reduce thickness and weight of an organic light emitting diode display device. Further, the organic light emitting diode display device has high-quality characteristics such as low power consumption, high luminance, and high response speed.

Each of a plurality of pixels included in the organic light emitting diode display device includes an organic light emitting diode and a driving transistor connected thereto. The driving transistor may provide a current to the organic light emitting diode according to a data voltage applied thereto so that the organic light emitting diode emits light with luminance corresponding to the data voltage.

When the driving transistors are deteriorated or a threshold voltage deviation (e.g., a threshold voltage variation) occurs between the driving transistors, an image of a desired color or brightness may not be displayed and the image quality of the organic light emitting diode display device may be deteriorated.

The above information disclosed in this Background section is only for enhancement of understanding of the background of the invention, and therefore it may contain information that does not form prior art.

SUMMARY

In some embodiments, in order to compensate for deterioration of the driving transistors and deviation (e.g., a variation) of the threshold voltage between the driving transistors, a current flowing through each of the plurality of pixels may be received to measure the threshold voltage of the driving transistor included in each pixel. In some embodiments, by compensating the data voltage based on the measured threshold voltage, deterioration of image quality due to the deterioration of the driving transistors and the deviation (e.g., the variation) of the threshold voltage between the driving transistors may be prevented or reduced. This method is referred to as external compensation.

When external light is incident on the driving transistor, the threshold voltage of the driving transistor may be lowered. When the external compensation is performed in an environment in which external light is incident, distortion may occur in a current received from the plurality of pixels due to the lowered threshold voltage of the driving transistor, and based on this, the compensated data voltage may be negatively shifted. That is, in a case in which the external light is incident on the driving transistor when the external compensation is performed, the data voltage may not be normally (or desirably) compensated.

Aspects of some example embodiments of the present disclosure are directed to an organic light emitting diode display device and a driving method thereof that may prevent a case in which the data voltage is not normally compensated by the external light when the external compensation is performed.

Some embodiments of the present disclosure provide an organic light emitting diode display device, including: a display area including a plurality of pixels; a compensation circuit configured to receive a current flowing through the plurality of pixels through a plurality of receiving lines connected to the plurality of pixels, and to generate a compensation value to compensate for deterioration of a driving transistor in each of the plurality of pixels based on the received current; a photo-sensor configured to measure external light to generate a light sensing signal; and a signal controller configured to cause the compensation circuit to generate the compensation value when no external light is incident on the photo-sensor such that the light sensing signal is received at a first voltage level and to perform external compensation to generate an image data signal by applying the compensation value to an image signal received from an external device.

The signal controller may not perform the external compensation by preventing the compensation circuit from generating the compensation value when the light sensing signal is received by the signal controller at a second voltage level that is higher than the first voltage level.

The photo-sensor may include a plurality of photodiodes configured to convert light energy to electrical energy.

The plurality of photodiodes may be distributed in the display area.

The display area may have first, second, third, and fourth quadrants, and the plurality of organic photodiodes may be located one by one in the first, second, third, and fourth quadrants.

The plurality of pixels may include a first pixel to emit red light, a second pixel to emit green light, and a third pixel to emit blue light, and the plurality of photodiodes may be at a position corresponding to one of a first pixel area corresponding to areas in which red light is to be emitted at some of the pixels, a second pixel area corresponding to areas in which green light is to be emitted at some of the pixels, and a third pixel area corresponding to areas in which blue light is to be emitted at some of the pixels.

The plurality of pixels may include a first pixel to emit red light, a second pixel to emit green light, and a third pixel to emit blue light, and the plurality of photodiodes may be located in the display area without overlapping a first pixel area in which the red light is to be emitted, a second pixel area in which the green light is to be emitted, and a third pixel area in which the blue light is to be emitted.

The organic light emitting diode display device may further include a peripheral area around the display area, wherein the plurality of photodiodes may be distributed in the peripheral area.

The display area may include four round corners, the peripheral area may include four peripheral portions adjacent to the four round corners, and the plurality of photodiodes may be distributed in the four peripheral portions.

The organic light emitting diode display device may further include a gravity sensor configured to measure a gravity direction to generate a gravity sensing signal indicating a direction toward which the display area is directed, wherein the signal controller may perform the external compensation by causing the compensation circuit to generate the compensation value when the direction indicated by the gravity sensing signal coincides with the gravity direction.

The signal controller may not perform the external compensation by causing the compensation circuit to not generate the compensation value when the direction indicated by the gravity sensing signal does not coincide with the gravity direction.

Some embodiments of the present disclosure provide a driving method of an organic light emitting diode display device, including: checking whether external light is detected by a photo-sensor; receiving a current flowing through a plurality of pixels through a plurality of receiving lines connected to the plurality of pixels when the external light is not detected; generating a compensation value to compensate for deterioration of a driving transistor in each of the plurality of pixels based on the received current; and performing external compensation to generate an image data signal by applying the compensation value to an image signal received from an external device.

The performing external compensation may not be performed by preventing the compensation value from being generated when external light is recognized by the photo-sensor.

The photo-sensor may include a plurality of photodiodes configured to convert light energy to electrical energy.

The plurality of photodiodes may be distributed in a display area including the plurality of pixels.

The plurality of pixels may include a first pixel to emit red light, a second pixel to emit green light, and a third pixel to emit blue light, and the plurality of photodiodes may be at a position corresponding to one of a first pixel area corresponding to areas in which red light is to be emitted at some of the pixels, a second pixel area corresponding to areas in which green light is to be emitted at some of the pixels, and a third pixel area corresponding to areas in which blue light is to be emitted at some of the pixels.

The plurality of photodiodes may be distributed in a peripheral area around a display area including the plurality of pixels.

The display area may include four round corners, the peripheral area may include four peripheral portions adjacent to the four round corners, and the plurality of photodiodes may be distributed in the four peripheral portions.

The driving method of the organic light emitting diode display device may further include generating a gravity sensing signal indicating a direction to which a screen on which an image is displayed is directed by measuring a gravity direction, wherein the performing external compensation may be performed when the external light is not recognized and when a direction indicated by the gravity sensing signal coincides with the gravity direction.

The performing external compensation may not be performed by preventing the compensation value from being generated when the direction indicated by the gravity sensing signal does not coincide with the gravity direction.

Aspects of some example embodiments of the present disclosure are directed to an organic light emitting diode display device that may perform external compensation under a condition in which external light is not incident on the driving transistor by using a photo-sensor, thereby preventing a problem in which a data voltage is not normally compensated by external light.

DETAILED DESCRIPTION

Figure 1:
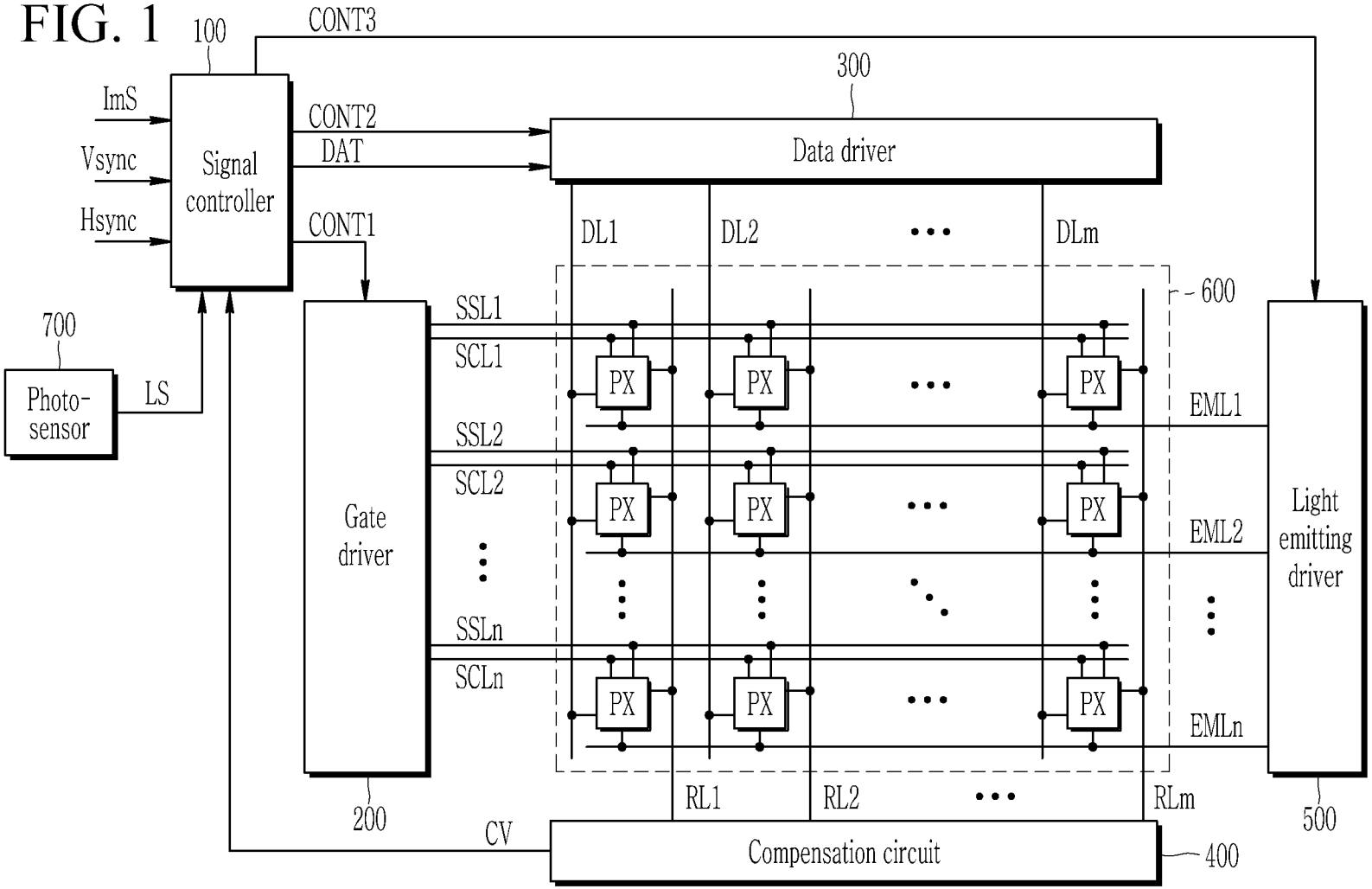
FIG. 1 illustrates a schematic diagram of an organic light emitting diode display device according to some embodiments of the present disclosure.

Embodiments of the present disclosure will be described more fully hereinafter with reference to the accompanying drawings, in which embodiments of the present disclosure are shown. As those skilled in the art would realize, the described embodiments may be modified in various different ways, all without departing from the spirit or scope of the present disclosure.

Furthermore, with embodiments of the present disclosure, detailed description is made as to the constituent elements in the first embodiment with reference to the relevant drawings by using the same reference numerals for the same constituent elements, while only the constituent elements that are different from those related to the first embodiment may be described in other embodiments.

Parts that are irrelevant to the description may be omitted to clearly describe the present disclosure, and like reference numerals designate like elements throughout the specification.

Further, in the drawings, the size and thickness of each element may be arbitrarily illustrated for ease of description, but the present disclosure is not necessarily limited to those illustrated in the drawings. In the drawings, the thicknesses of layers, films, panels, regions, etc., may be exaggerated for clarity. In the drawings, for ease of description, the thicknesses of some layers and areas may be exaggerated.

In the present specification, unless explicitly described to the contrary, the terms "comprise" and "include" and variations such as "comprises," "comprising," "includes," and "including" will be understood to imply the inclusion of stated elements but not the exclusion of any other elements.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the present disclosure.

As used herein, the phrases such as, "a plan view" or "a top view," or "a top plan view," may refer to a view from top or from a direction normal to the display area (or display plane) of the display device.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept."

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the terms "use," "using," and "used" may be considered synonymous with the terms "utilize," "utilizing," and "utilized," respectively.

FIG. 1 illustrates a block diagram of an organic light emitting diode display device according to some embodiments.

Referring to FIG. 1, the organic light emitting diode display device includes a signal controller 100, a gate driver 200, a data driver 300, a compensation circuit 400, a light emitting driver 500, a display part 600, and a photo-sensor 700.

The signal controller 100 receives an image signal ImS and one or more synchronization signals from an external device. The image signal ImS includes luminance information of a plurality of pixels PX. The luminance information includes a set (e.g., predetermined) number of gray levels. By way of example, each of the pixels may have a corresponding gray level during each image frame, and may emit a corresponding color light according to the gray level included in the luminance information. The one or more synchronization signals may include a horizontal synchronizing signal Hsync and a vertical synchronizing signal Vsync.

The signal controller 100 may classify the image signal ImS in units of frames according to the vertical synchronization signal Vsync, and classify the image signal ImS in units of scan lines SCL1 to SCLn according to the horizontal synchronization signal Hsync. The signal controller 100 may properly process the image signal ImS according to operating conditions of the display part 600 and the data driver 300 based on the image signal ImS and the synchronization signal, and may generate an image data signal DAT, a first control signal CONT1, a second control signal CONT2, and a third control signal CONT3. The signal controller 100 transmits the first control signal CONT1 to the gate driver 200. The signal controller 100 transmits the second control signal CONT2 and the image data signal DAT to the data driver 300. The signal controller 100 transmits the third control signal CONT3 to the light emitting driver 500.

The display part 600 includes a plurality of scan lines SCL1 to SCLn, a plurality of sensing lines SSL1 to SSLn, a plurality of data lines DL1 to DLm, a plurality of receiving lines RL1 to RLm, a plurality of light emitting lines EML1-EMLn, and the plurality of pixels PX. The plurality of pixels PX may be connected to the plurality of scan lines SCL1 to SCLn, the plurality of sensing lines SSL1 to SSLn, the plurality of data lines DL1 to DLm, the plurality of receiving lines RL1 to RLm, and the plurality of light emitting lines EML1 to EMLn. The plurality of scan lines SCL1 to SCLn may extend substantially in a row direction and may be substantially parallel to each other. The plurality of sensing lines SSL1 to SSLn may extend substantially in the row direction and may be substantially parallel to each other. The plurality of data lines DL1 to DLm may extend substantially in a column direction and may be substantially parallel to each other. The plurality of receiving lines RL1 to RLm may extend substantially in the column direction and may be substantially parallel to each other. The plurality of light emitting lines EML1 to EMLn may extend substantially in the row direction and may be substantially parallel to each other. The display part 600 may correspond to a display area in which an image is displayed. The display area may correspond to a screen on which an image is displayed.

Figure 2:
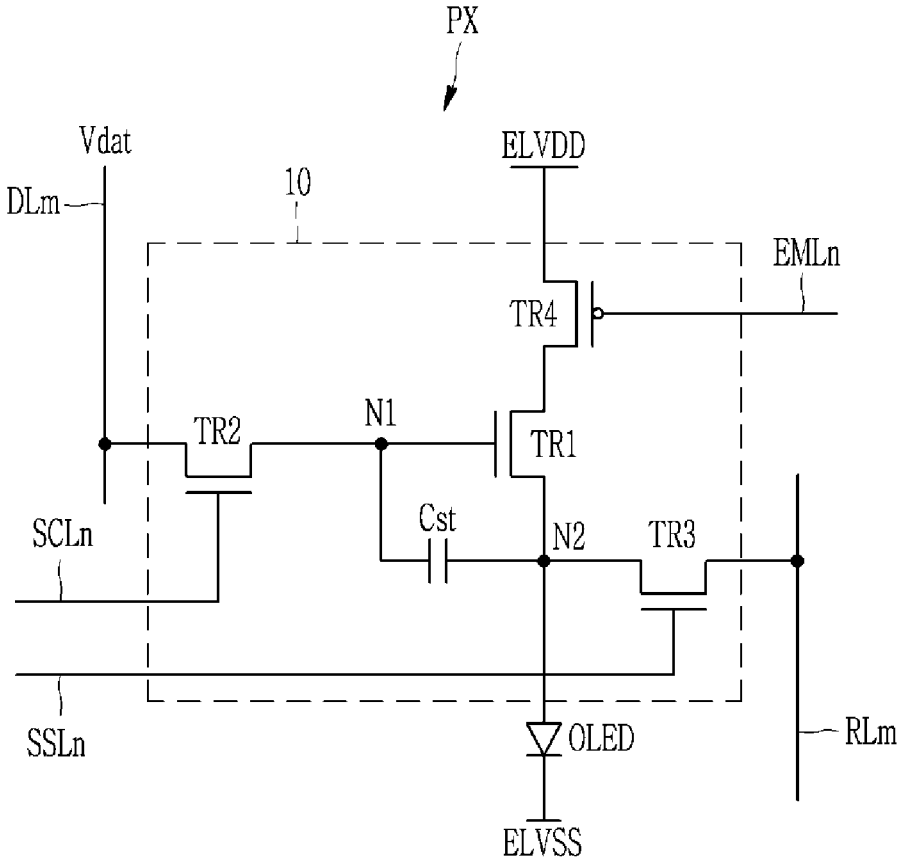
FIG. 2 illustrates a circuit diagram of a pixel according to some embodiments of the present disclosure.

In some embodiments, the display part 600 may be supplied with a first power supply voltage (e.g., see ELVDD of FIG. 2) and a second power supply voltage (e.g., see ELVSS of FIG. 2). The first power supply voltage ELVDD may be a high level voltage provided to an anode electrode of an organic light emitting diode (e.g., see OLED of FIG. 2) included in each of the plurality of pixels PX. The second power supply voltage ELVSS may be a low level voltage provided to a cathode electrode of the organic light emitting diode OLED included in each of the plurality of pixels PX. The first power supply voltage ELVDD and the second power supply voltage ELVSS are driving voltages for emitting light from the plurality of pixels PX. By way of example, the organic light emitting diode OLED included in each pixel emits light when a current flows therethrough from the source of the first power supply voltage ELVDD to the source of the second power source voltage ELVSS.

The gate driver 200 is connected to the plurality of scan lines SCL1 to SCLn and the plurality of sensing lines SSL1 to SSLn. The gate driver 200 applies a scan signal, which is a combination of a gate-on voltage and a gate-off voltage, to the plurality of scan lines SCL1 to SCLn, and applies a sensing signal, which is a combination of the gate-on voltage and the gate-off voltage, to the plurality of sensing lines SSL1 to SSLn according to the first control signal CONT1. The gate driver 200 may sequentially apply the scan signal of the gate-on voltage to the plurality of scan lines SCL1 to SCLn. The gate driver 200 may sequentially apply the sensing signal of the gate-on voltage to the plurality of sensing lines SSL1 to SSLn.

The data driver 300 is connected to the plurality of data lines DL1 to DLm. According to some embodiments, the data driver 300 samples and holds the image data signal DAT, and applies a data voltage (e.g., see Vdat of FIG. 2) to the plurality of data lines DL1 to DLm according to the second control signal CONT2. By way of example, the data driver 300 may hold the image data signal DAT in digital form, and provide the data voltage Vdat as a corresponding analog signal. The data driver 300 may apply the data voltage Vdat having a set (e.g., predetermined) voltage range to the plurality of data lines DL1 to DLm in response to the scan signal of the gate-on voltage.

The compensation circuit 400 is connected to the plurality of receiving lines RL1 to RLm, and receives a current flowing through the plurality of pixels PX through the plurality of receiving lines RL1 to RLm. The compensation circuit 400 may measure (or determine) a threshold voltage of a driving transistor (see TR1 of FIG. 2) included in each of the plurality of pixels PX based on the received current. The compensation circuit 400 may calculate deterioration of each of the plurality of driving transistors TR1 included in the plurality of pixels PX and a deviation (e.g., a variation) between the plurality of driving transistors TR1 based on the threshold voltage of the driving transistor TR1. The compensation circuit 400 may generate a compensation value CV based on the deterioration of the plurality of driving transistors TR1 and the deviation (e.g., the variation) between the plurality of driving transistors TR1, and provide the compensation value CV to the signal controller 100. The compensation value CV may include a value that compensates for the deterioration of each of the plurality of driving transistors TR1 included in the plurality of pixels PX and the deviation (e.g., the variation) between the plurality of driving transistors TR1.

The signal controller 100 generates the image data signal DAT by applying the compensation value CV to the image signal ImS, and the data driver 300 generates the data voltage Vdat according to the image data signal DAT to which the compensation value CV is applied. By applying the compensation value CV to the image signal ImS, the image quality deterioration due to the deterioration of the driving transistor TR1 and the deviation (e.g., the variation) of the plurality of driving transistors TR1 may not occur or may be reduced. By way of example, the driving transistors may have non-uniform characteristics (e.g., threshold voltages), and may also deteriorate at different rates. The compensation value CV takes account of the variation and the deterioration and compensates the image signal ImS to generate the image data signal DAT.

As described above, a method of receiving the current flowing through the plurality of pixels PX and compensating for the degradation of the driving transistors TR1 included in each of the plurality of pixels PX and the deviation (e.g., the variation) between the plurality of driving transistors TR1 based on the received current is referred to as external compensation.

Referring back to FIG. 1, FIG. 1 illustrates that the compensation circuit 400 is separately provided from the signal controller 100, but in some embodiments, the compensation circuit 400 may be included in the signal controller 100.

The light emitting driver 500 is connected to the plurality of light emitting lines EML1 to EMLn. The light emitting driver 500 applies the light emitting signal, which is the combination of the gate-on voltage and the gate-off voltage, to the plurality of light emitting lines EML1 to EMLn according to the third control signal CONT3. The light emitting driver 500 may sequentially or concurrently (e.g., simultaneously) apply a light emitting signal having a gate-on voltage to the plurality of light emitting lines EML1 to EMLn.

In some embodiments, the photo-sensor 700 measures (or detects) external light to generate a light sensing signal LS. A voltage level of the light sensing signal LS may be proportional to illuminance of the external light. For example, when no external light is incident on the photo-sensor 700, the photo-sensor 700 may generate a light sensing signal LS having a low level voltage. When external light is incident on the photo-sensor 700, the photo-sensor 700 may generate a light sensing signal LS having a high level voltage that is higher (or greater) than the low level voltage. The photo-sensor 700 transmits the light sensing signal LS to the signal controller 100.

The photo-sensor 700 may include a photodiode for converting light energy into electrical energy. The photodiode may be an organic photodiode (OPD) including an organic material that is sensitive to a particular wavelength range. In some embodiments, the organic photodiode may be formed together in a process of forming the plurality of pixels PX, and may be formed in a display panel including the plurality of pixels PX. The photo-sensor 700 may include a plurality of organic photodiodes. While the photo-sensor 700 in embodiments of the present disclosure is described as including a plurality of organic photodiodes, embodiments of the present disclosure are not limited thereto. For example, the photo-sensor 700 may include any suitable photodiode known to those skilled in the art. The plurality of organic photodiodes may be disposed in the display area or in a peripheral area surrounding the display area to measure (or detect) whether external light is incident on the display area and/or in the peripheral area surrounding the display area.

When the light sensing signal LS is received at the low level voltage from the photo-sensor 700, the signal controller 100 may perform the external compensation by causing the compensation circuit 400 to generate the compensation value CV. When the light sensing signal LS is received at the high level voltage that is higher (or greater) than the low level voltage, the signal controller 100 may not perform the external compensation by preventing the compensation circuit 400 from generating the compensation value CV. That is, the signal controller 100 may perform the external compensation when no external light is incident on the display area and/or in the peripheral area surrounding the display area. The signal controller 100 may perform the external compensation when no external light is incident on the plurality of pixels PX. In some embodiments, the signal controller 100 may perform the external compensation when no external light is incident on the driving transistor TR1 included in the plurality of pixels PX.

The organic light emitting diode display device may perform the external compensation under a condition in which external light is not incident on the driving transistor TR1 by using the photo-sensor 700, thereby preventing a problem in which a data voltage is not normally compensated by external light.

FIG. 2 illustrates a circuit diagram of a pixel according to some embodiments of the present disclosure. The pixel PX disposed in an n-th pixel row and an m-th pixel column from among the plurality of pixels PX included in the display device of FIG. 1 may be described as an example.

Referring to FIG. 2, the pixel PX includes an organic light emitting diode OLED and a pixel circuit 10.

The pixel circuit 10 is configured to control a current flowing from the source of the first power supply voltage ELVDD through the organic light emitting diode OLED to the source of the second power supply voltage ELVSS. The pixel circuit 10 may include a driving transistor TR1, a switching transistor TR2, a sensing transistor TR3, a light emitting transistor TR4, and a storage capacitor Cst.

The driving transistor TR1 includes a gate electrode connected to a first node N1, a first electrode to which the first power voltage ELVDD is applied through the light emitting transistor TR4, and a second electrode connected to a second node N2. The driving transistor TR1 is connected between the first power supply voltage ELVDD and the organic light emitting diode OLED, and corresponds to a voltage of the first node N1 (e.g., the gate electrode of the driving transistor TR1 is connected to the first note N1) to control an amount of current flowing from the first power supply voltage ELVDD to the organic light emitting diode OLED. By way of example, because the driving transistor is n-type (e.g., an n-channel field effect transistor) in FIG. 2, higher voltage level at the first node N1 generally results in a current of higher magnitude flowing to the organic light emitting diode OLED. In other embodiments, when the driving transistor is p-type (e.g., a p-channel field effect transistor), a higher voltage level at the first node generally results in a current of a lower magnitude flowing to the organic light emitting diode OLED.

The switching transistor TR2 includes a gate electrode connected to the scan line SCLn, a first electrode connected to the data line DLm, and a second electrode connected to the first node N1. The switching transistor TR2 is connected between the data line DLm and the driving transistor TR1 (e.g., the gate electrode of the driving transistor TR1), and is turned on by a scan signal of the gate-on voltage applied to the scan line SCLn to transmit the data voltage Vdat applied to the data line DLm to the first node N1.

The sensing transistor TR3 includes a gate electrode connected to the sensing line SSLn, a first electrode connected to the second node N2, and a second electrode connected to the receiving line RLm. The sensing transistor TR3 is connected between the second electrode of the driving transistor TR1 and the receiving line RLm, and it is turned on by a sensing signal of a gate-on voltage applied to the sensing line SSLn to transmit the current flowing to the organic light emitting diode OLED through the driving transistor TR1 to the receiving line RLm. Meanwhile, the receiving line RLm may be used as a wire for transmitting an initialization voltage to the second node N2. As the initialization voltage is applied to the second node N2 through the receiving line RLm, the anode voltage of the organic light emitting diode OLED may be initialized.

The light emitting transistor TR4 includes a gate electrode connected to the light emitting line EMLn, a first electrode to which the first power supply voltage ELVDD is applied, and a second electrode connected to the first electrode of the driving transistor TR1. The light emitting transistor TR4 is turned on by the light emitting signal of the gate-on voltage applied to the light emitting line EMLn to transmit the first power voltage ELVDD to the driving transistor TR1.

The driving transistor TR1, the switching transistor TR2, and the sensing transistor TR3 may be n-channel field effect transistors, and the light emitting transistor TR4 may be a p-channel field effect transistor. The gate-on voltage for turning on the n-channel field effect transistor is a high level voltage, and the gate-off voltage for turning it off is a low level voltage. The gate-on voltage for turning on the p-channel field effect transistor is a low level voltage, and the gate-off voltage for turning it off is a high level voltage. In some embodiments, at least one of the driving transistor TR1, the switching transistor TR2, and the sensing transistor TR3 may be a p-channel field effect transistor, and/or the light emitting transistor TR4 may be an n-channel field effect transistor. In some other embodiments, all of the transistors TR1, TR2, TR3, and TR4 may be either n-channel field effect transistors or p-channel field effect transistors. Those skilled in the art would appreciate the different signal voltage levels to be applied based on the types of transistors used.

The storage capacitor Cst includes a first electrode connected to the first node N1 and a second electrode connected to the second node N2. The data voltage Vdat is transmitted to the first node N1, and the storage capacitor Cst maintains the voltage of the first node N1.

The organic light emitting diode OLED includes an anode electrode connected to the second node N2 and a cathode electrode to which the second power supply voltage ELVSS is applied. The organic light emitting diode OLED may emit light at a luminance corresponding to a current supplied from the pixel circuit 10. The organic light emitting diode OLED may emit light having one of primary colors or a white color. An example of the primary colors may include three primary colors of light such as red, green, and blue. Another example of the primary colors may include three primary colors such as yellow, cyan, and magenta.

During the external compensation, a scan signal of the gate-on voltage is applied to the scan line SCLn, a data voltage of a set (e.g., predetermined) level is applied to the data line DLm, and a light emitting signal of the gate-on voltage is applied to the light emitting line EMLn. A data voltage having a set (e.g., predetermined) level is applied to the gate electrode of the driving transistor TR1, and a current flows from the first power supply voltage ELVDD to the organic light emitting diode OLED through the driving transistor TR1. In this case, the sensing signal of the gate-on voltage is applied to the sensing line SSLn so that a current flowing through the organic light emitting diode OLED may be transmitted to the compensation circuit 400 through the sensing transistor TR3. The compensation circuit 400 may measure (or determine) the threshold voltage of the driving transistor TR1 by comparing a reference current corresponding to the data voltage of the set (e.g., predetermined) level with the current flowing through the organic light emitting diode OLED of each pixel PX.

Hereinafter, some embodiments in which the photo-sensor 700 is disposed in the display area of the organic light emitting diode display will be described with reference to FIGS. 3-6.

Figure 3:
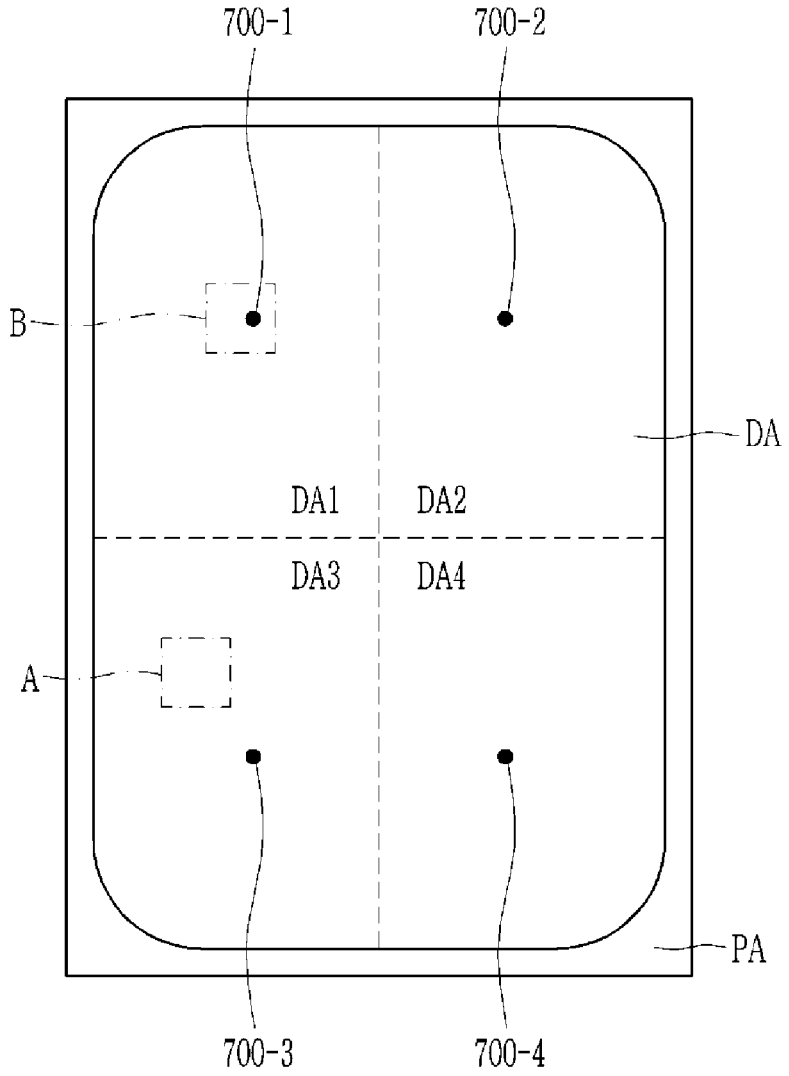
FIG. 3 illustrates a top plan view of an organic light emitting diode display device including a photo-sensor according to some embodiments of the present disclosure.
Figure 4:
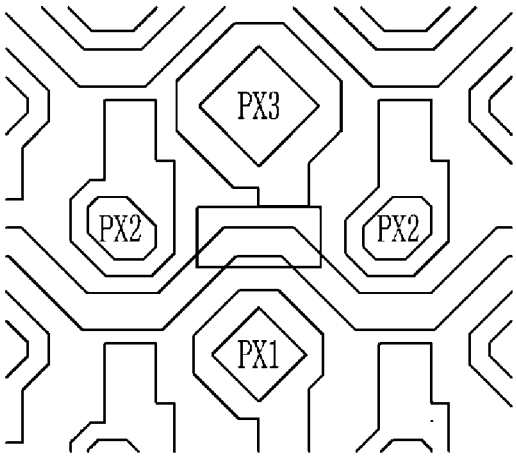
FIG. 4 illustrates a top plan view of pixels included in portion A of FIG. 3 according to some embodiments of the present disclosure.
Figure 5:
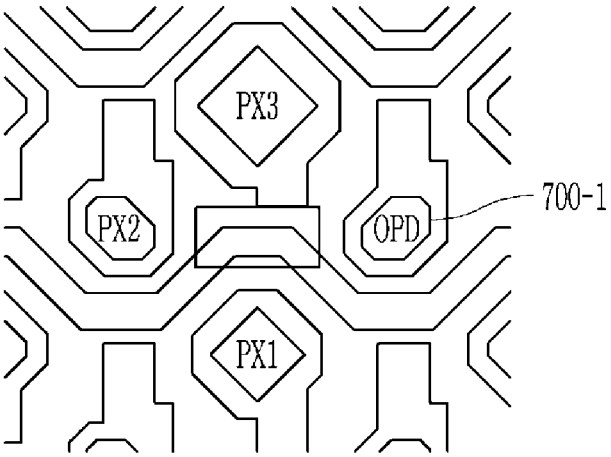
FIG. 5 illustrates a top plan view of pixels and a photo-sensor included in portion B of FIG. 3 according to some embodiments of the present disclosure.
Figure 6:
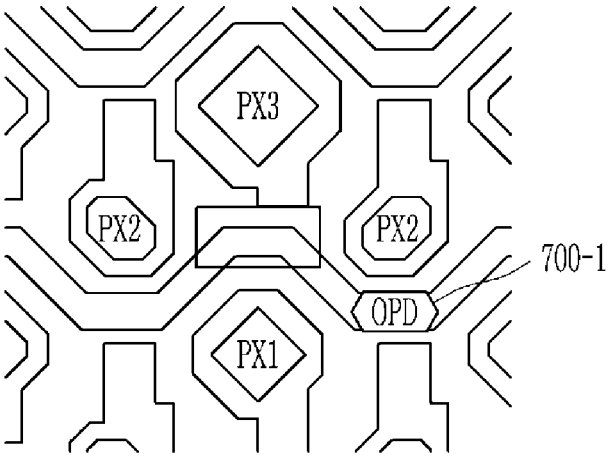
FIG. 6 illustrates a top plan view of pixels and a photo-sensor included in portion B of FIG. 3 according to some embodiments of the present disclosure.

FIG. 3 illustrates a top plan view of an organic light emitting diode display device including a photo-sensor according to some embodiments of the present disclosure. FIG. 4 illustrates a top plan view of pixels included in portion A of FIG. 3 according to some embodiments of the present disclosure. FIG. 5 illustrates a top plan view of pixels and a photo-sensor included in portion B of FIG. 3 according to some embodiments of the present disclosure. FIG. 6 illustrates a top plan view of pixels and a photo-sensor included in portion B of FIG. 3 according to some embodiments of the present disclosure.

Referring to FIG. 3, the organic light emitting diode display device may include a display area DA and a peripheral area PA. The display area DA includes the plurality of pixels PX, and is an area for displaying an image using the plurality of pixels. The peripheral area PA is an area that is disposed around the display area DA and in which no image is displayed. The peripheral area PA may surround the display area DA. A wire, a circuit, and the like used for driving the OLED display device may be formed in or located the peripheral area PA. For example, the gate driver 200, the light emitting driver 500, and the like may be integrated in the peripheral area PA, or a printed circuit board on which the signal controller 100, the data driver 300, the compensation circuit 400, and the like are mounted, may be connected to or in the peripheral area PA.

The photo-sensor 700 may include a plurality of organic photodiodes 700-1, 700-2, 700-3, and 700-4. The plurality of organic photodiodes 700-1, 700-2, 700-3, and 700-4 may be disposed to be distributed in the display area DA.

As illustrated, when the display area DA is divided into (i.e., has) first to fourth quadrants (indicated by a dotted line in FIG. 3) DA1, DA2, DA3, and DA4, the plurality of organic photodiodes 700-1, 700-2, 700-3, and 700-4 may be distributed and disposed, respectively, in the first to fourth quadrants DA1, DA2, DA3, and DA4. The first organic photodiode 700-1 may be disposed in the first quadrant DA1, the second organic photodiode 700-2 may be disposed in the second quadrant DA2, the third organic photodiode 700-3 may be disposed in the third quadrant DA3, and the fourth organic photodiode 700-4 may be disposed in the fourth quadrant DA4.

The signal controller 100 may perform the external compensation when all the light sensing signals LS received from the plurality of organic photodiodes 700-1, 700-2, 700-3, and 700-4 are received at a low level voltage. When at least one of the plurality of organic photodiodes 700-1, 700-2, 700-3, and 700-4 transmits a light sensing signal LS having a high level voltage to the signal controller 100, the signal controller 100 does not perform the external compensation. Accordingly, even when the external light is incident only on or at a portion of the display area DA, external compensation is not performed. That is, when an external light is not incident on any of the portions of the display area DA (e.g., no external light is detected by the plurality of organic photodiodes), the external compensation may be performed. Thus a problem that the data voltage is not normally compensated by the external light does not occur.

Referring now to FIG. 4, the plurality of pixels PX included in the display area DA may include a first pixel PX1, a second pixel PX2, and a third pixel PX3. The first pixel PX1 may be a red pixel for emitting red light, the second pixel PX2 may be a green pixel for emitting green light, and the third pixel PX3 may be a blue pixel for emitting blue light. An area where the red light is emitted is referred to as a first pixel area, an area where the green light is emitted is referred to as a second pixel area, and an area where blue light is emitted is referred to as a third pixel area.

The first to third pixel areas may be disposed in a PENTILE® (PENTILE® is a registered trademark of Samsung Display Co., Ltd., Republic of Korea) structure, and wires such as the gate line, the data line, the light emitting line, and the receiving line may be disposed around the first to third pixel areas. A light blocking pattern that blocks light is disposed in a portion of the display area DA except for the first to third pixel areas. The light blocking pattern may cover the wires such as the gate line, the data line, the light emitting line, and the receiving line, so that the gate line, the data line, the light emitting line, and the receiving line may not be viewed by (or visible to) a user.

FIG. 5 exemplarily shows the first organic photodiode 700-1 disposed in the first quadrant DA1 of the display area DA according to some embodiments. The first organic photodiode 700-1 may be disposed at a position corresponding to one of the plurality of second pixel areas disposed in the first quadrant DA1. That is, in some embodiments, in one of the plurality of second pixel areas, the first organic photodiode 700-1 may be formed instead of the organic light emitting diode OLED as shown in FIG. 5.

Similarly, in the second to fourth quadrants DA2, DA3, and DA4 of the display area DA, the organic photodiode OPD may be disposed as the photo-sensor 700 at a position corresponding to one second pixel area of the plurality of second pixel areas.

In FIG. 5, it is exemplarily illustrated that the organic photodiode OPD is disposed at the position corresponding to the second pixel area, but the embodiments of the present disclosure are not limited thereto, and the organic photodiode OPD may be disposed at a position corresponding to the first pixel area or the third pixel area.

FIG. 6 exemplarily shows the first organic photodiode 700-1 disposed in the first quadrant DA1 of the display area DA. The first organic photodiode 700-1 may be disposed adjacent to the first to third pixel areas in the display area DA without overlapping the first to third pixel areas. For example, in some embodiments, the first organic photodiode 700-1 in the display area DA may not overlap the first to third pixel areas when viewed in a plan view. In this case, the light blocking pattern may include a hole corresponding to the first organic photodiode 700-1, and the external light may be incident on the first organic photodiode 700-1 through the hole.

Similarly, in the second to fourth quadrants DA2, DA3, and DA4 of the display area DA, the organic photodiode OPD as the photo-sensor 700 may be disposed at a position not overlapping the first to third pixel areas in the display area DA. For example, in some embodiments, organic photodiode OPD may be at a position not overlapping the first to third pixel areas in the display area DA when viewed in a plan view.

Hereinafter, some embodiments in which the photo-sensor 700 is disposed in the peripheral area of the organic light emitting diode display device may be described with reference to FIG. 7.

Figure 7:
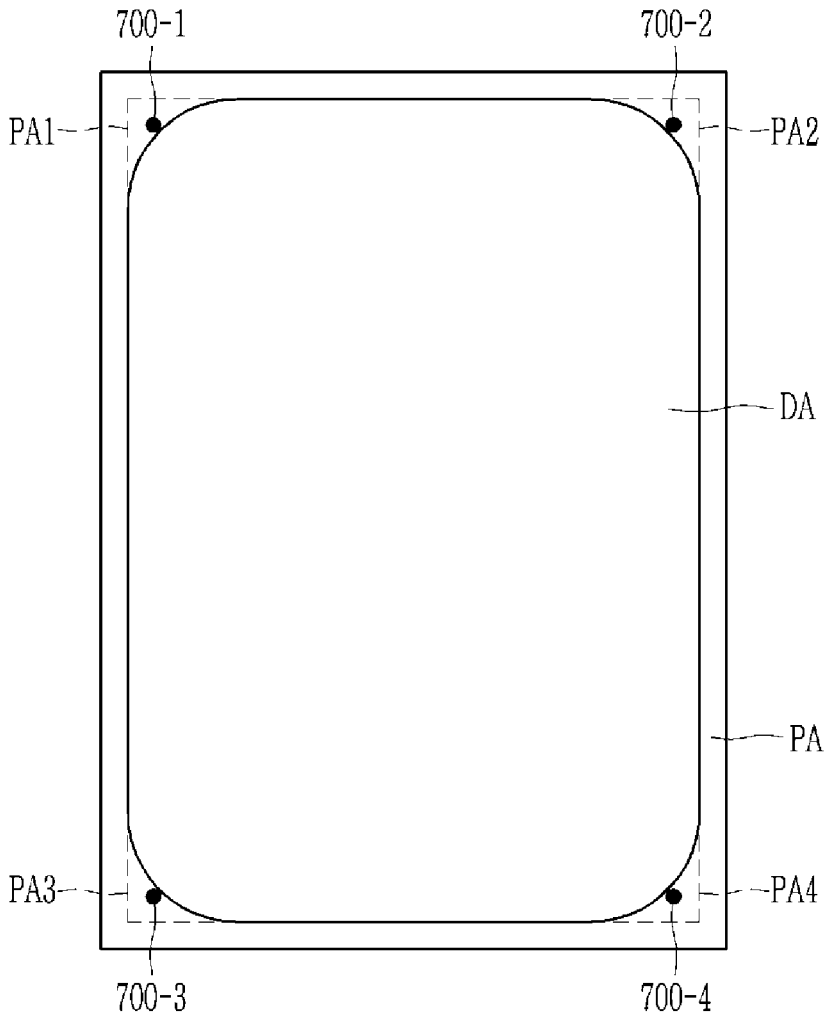
FIG. 7 illustrates a top plan view of an organic light emitting diode display device including a photo-sensor according to some embodiments of the present disclosure.

FIG. 7 illustrates a top plan view of an organic light emitting diode display device including a photo-sensor according to some embodiments of the present disclosure.

Referring to FIG. 7, the organic light emitting diode display device may include the display area DA and the peripheral area PA. The photo-sensor 700 may include the plurality of organic photodiodes 700-1, 700-2, 700-3, and 700-4, and the plurality of organic photodiodes 700-1, 700-2, 700-3, and 700-4 may be distributed and disposed in the peripheral area PA.

As illustrated in FIG. 7, four corners of the display area DA may be round, and the peripheral area PA may include first to fourth peripheral portions PA1, PA2, PA3, and PA4, which are adjacent to the four corners of the display area. The plurality of organic photodiodes 700-1, 700-2, 700-3, and 700-4 may be distributed and disposed in the first to fourth peripheral portions PA1, PA2, PA3, and PA4. The first organic photodiode 700-1 may be disposed at the first peripheral portion PA1, the second organic photodiode 700-2 may be disposed at the second peripheral portion PA2, the third organic photodiode 700-3 may be disposed at the third peripheral portion PA3, and the fourth organic photodiode 700-4 may be disposed at the fourth peripheral portion PA4.

A wire, a circuit, and the like used for driving the organic light emitting diode display device are formed in the peripheral area PA, and a light blocking pattern is formed in the peripheral area PA so that the wire, the circuit, and the like are not viewed by a user. The light blocking pattern may include holes corresponding to the first to fourth organic photodiodes 700-1, 700-2, 700-3, and 700-4 in the first to fourth peripheral portions PA1, PA2, PA3, and PA4. The external light may be incident on the first to fourth organic photodiodes 700-1, 700-2, 700-3, and 700-4 through the holes.

When all of the light sensing signals LS received from the first to fourth organic photodiodes 700-1, 700-2, 700-3, and 700-4 have low level voltages, it may be considered that no external light is incident on any of the portions of the display area DA. The signal controller 100 may perform the external compensation when all the light sensing signals LS received from the first to fourth organic photodiodes 700-1, 700-2, 700-3, and 700-4 are received at a low level voltage, and thus the problem that the data voltage is not normally compensated by the external light does not occur.

Figure 8:
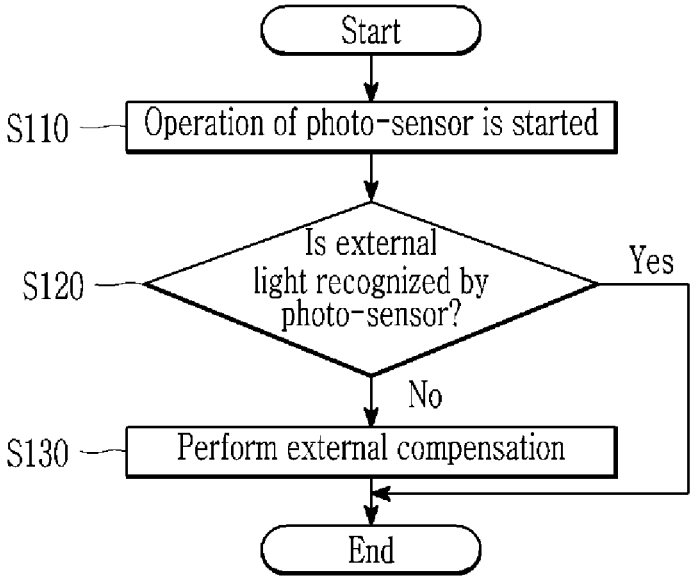
FIG. 8 illustrates a flowchart of a driving method of an organic light emitting diode display device according to some embodiments of the present disclosure.

FIG. 8 illustrates a flowchart of a driving method of an organic light emitting diode display device according to some embodiments of the present disclosure.

Referring to FIG. 8, an operation of the photo-sensor 700 included in the organic light emitting diode display device is started (S110). When the organic light emitting diode display device is powered on, the operation of the photo-sensor 700 may start.

The signal controller 100 checks whether external light is recognized (or detected) by the photo-sensor 700 (S120). The photo-sensor 700 may include the plurality of organic photodiodes 700-1, 700-2, 700-3, and 700-4. The signal controller 100 may determine that the external light is not recognized (or detected) when all the light sensing signals LS received from the plurality of organic photodiodes 700-1, 700-2, 700-3, and 700-4 are received at a low level voltage. The signal controller 100 may determine that the external light is recognized when at least one of the light sensing signals LS received from the plurality of organic photodiodes 700-1, 700-2, 700-3, and 700-4 is received at a high level voltage that is higher (or greater) than the low level voltage.

The signal controller 100 may perform the external compensation when the external light is not recognized (S130). Depending on the control of the signal controller 100, the gate driver 200 applies the scan signal and the sensing signal of the gate-on voltage to the plurality of pixels PX, and the data driver 300 applies the data voltage having a set (e.g., predetermined) level to the plurality of pixels PX. The compensation circuit 400 receives the current flowing through the plurality of pixels PX to measure (or determine) the threshold voltage of the driving transistor TR1 of each pixel PX, and generates the compensation value CV based on the measured (or determined) threshold voltages to transmit it to the signal controller 100. The signal controller 100 generates the image data signal DAT by applying the compensation value CV to the image signal ImS, and the data driver 300 generates the data voltage Vdat according to the image data signal DAT to which the compensation value CV is applied. Accordingly, it is possible to prevent or reduce the degradation of the driving transistor TR1 included in the plurality of pixels PX and the degradation due to the deviation (e.g., the variation) between the driving transistors TR1.

The signal controller 100 does not perform the external compensation when the external light is recognized by the photo-sensor 700. By way of example, when any of the photodiodes detects external light, the signal controller 100 does not perform the external compensation.

Figure 9:
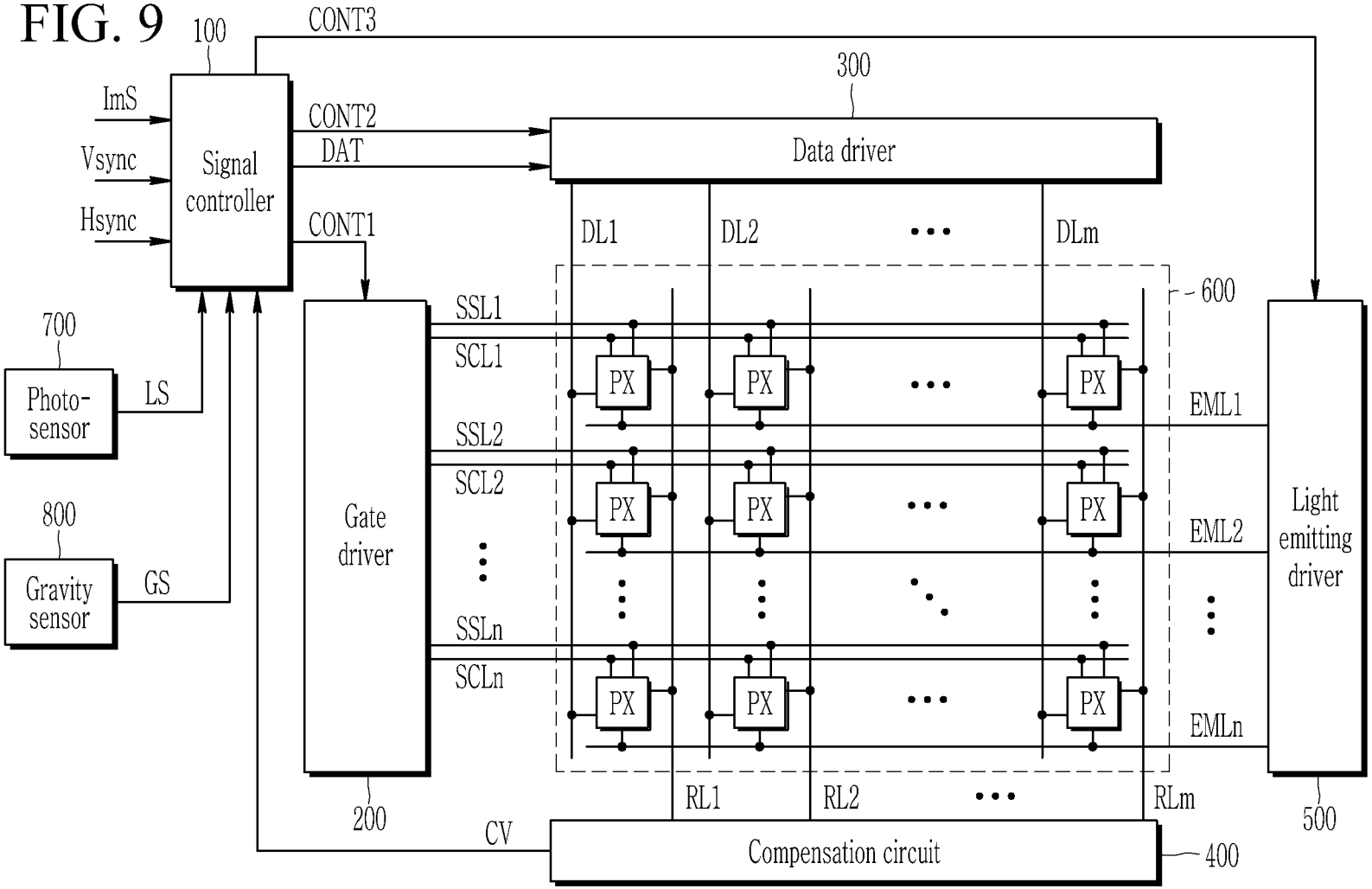
FIG. 9 illustrates a schematic diagram of an organic light emitting diode display device according to some embodiments of the present disclosure.

FIG. 9 illustrates a block diagram of an organic light emitting diode display device according to some embodiments of the present disclosure.

Referring to FIG. 9, the organic light emitting diode display device may further include a gravity sensor 800 that measures (or determines) a gravity direction (i.e., a direction toward the ground or a downward direction). The gravity sensor 800 transmits, to the signal controller 100, a gravity sensing signal GS indicating a direction that a display area (or a screen) on which an image is displayed faces. In some embodiments, the gravity sensing signal GS indicates a direction (depending on the orientation of the device) that a display area faces based on the gravity direction measured (or determined) by the gravity sensor 800.

The signal controller 100 may perform the external compensation when the light sensing signal LS having a low level voltage is received from the photo-sensor 700 and the gravity sensing signal GS indicating a direction coinciding with (e.g., having the same direction as) the gravity direction is received from the gravity sensor 800. The fact that the direction that the display area (or the screen) faces coincides with the gravity direction may be regarded as the display area facing the ground so that the display area is covered by an object on the ground such that no external light enters the display area. The signal controller 100 does not perform external compensation when the light sensing signal LS is received at a high level voltage or when the gravity sensing signal GS indicating a direction that does not coincide with the gravity direction is received. In some embodiments, external compensation is not performed when external light is detected or when the display area (or the screen) faces away from the ground.

Except for the above-described differences, the features of the embodiments described above with reference to FIGS. 1-7 may be applied to the embodiments described with reference to FIG. 9, so redundant descriptions may be omitted.

Figure 10:
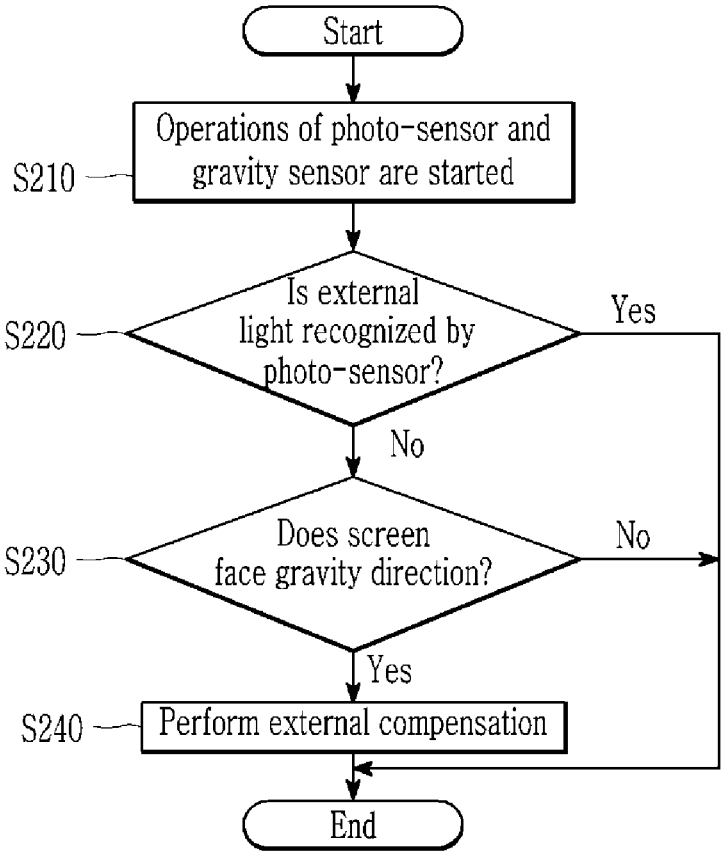
FIG. 10 illustrates a flowchart of a driving method of an organic light emitting diode display device according to some embodiments of the present disclosure.

FIG. 10 illustrates a flowchart of a driving method of an organic light emitting diode display device according to some embodiments of the present disclosure.

Referring to FIG. 10, operations of the photo-sensor 700 and the gravity sensor 800 included in the organic light emitting diode display device are started at S210. When the organic light emitting diode display device is powered on, the operation of the photo-sensor 700 and the gravity sensor 800 may start.

The signal controller 100 checks whether the external light is recognized by the photo-sensor 700 (S220). The photo-sensor 700 may include the plurality of organic photodiodes 700-1, 700-2, 700-3, and 700-4. The signal controller 100 may determine that external light is not recognized when all the light sensing signals LS received from the plurality of organic photodiodes 700-1, 700-2, 700-3, and 700-4 are received at a low level voltage. The signal controller 100 may determine that the external light is recognized when at least one of the light sensing signals LS received from the plurality of organic photodiodes 700-1, 700-2, 700-3, and 700-4 is received at a high level voltage that is higher (or greater) than the low level voltage.

When no external light is recognized, the signal controller 100 checks whether the screen faces the gravity direction (i.e., a downward direction) (S230). That is, the signal controller 100 may receive the gravity sensing signal GS indicating the direction that the screen faces from the gravity sensor 800, and may check whether the direction indicated by the gravity sensing signal GS coincides with the gravity direction.

The signal controller 100 may perform the external compensation when the screen faces the gravity direction (S240). That is, the signal controller 100 may perform the external compensation when the light sensing signal LS having a low level voltage is received from the photo-sensor 700 and the gravity sensing signal GS indicating a direction coincides with the gravity direction is received from the gravity sensor 800.

The signal controller 100 does not perform the external compensation when the external light is recognized by the photo-sensor 700 or the fact that the screen does not face the gravity direction is recognized by the gravity sensor 800.

Except for the above-described differences, the features of the embodiments described above with reference to FIG. 8 may be applied to the embodiments described with reference to FIG. 10, so redundant descriptions may be omitted.

The accompanying drawings and the detailed description of the embodiments of the present disclosure are only illustrative, and are used for the purpose of describing the present disclosure but are not used to limit the meanings or scope of the present disclosure described in the claims. Therefore, those skilled in the art will understand that various modifications and other equivalent embodiments of the present disclosure are possible. Consequently, the true technical protective scope of the present disclosure must be determined based on the technical spirit of the appended claims, and equivalents thereof.

What is claimed is:

1. An organic light emitting diode display device, comprising:

a display area comprising a plurality of pixels;

a compensation circuit configured to receive a current flowing through the plurality of pixels through a plurality of receiving lines connected to the plurality of pixels, and to generate a compensation value to compensate for deterioration of a driving transistor in each of the plurality of pixels based on the received current;

a photo-sensor configured to measure external light to generate a light sensing signal; and a signal controller configured to cause the compensation circuit to generate the compensation value when no external light is incident on the photo-sensor such that the light sensing signal is received at a first voltage level, and to perform external compensation to generate an image data signal by applying the compensation value to an image signal received from an external device.

2. The organic light emitting diode display device of claim 1, wherein the signal controller is further configured to not perform the external compensation by preventing the compensation circuit from generating the compensation value when the light sensing signal is received by the signal controller at a second voltage level that is higher than the first voltage level.

3. The organic light emitting diode display device of claim 1, wherein the photo-sensor comprises a plurality of photodiodes configured to convert light energy to electrical energy.

4. The organic light emitting diode display device of claim 3, wherein the plurality of photodiodes is distributed in the display area.

5. The organic light emitting diode display device of claim 4, wherein the display area has first, second, third, and fourth quadrants, and the plurality of photodiodes are located one by one in the first, second, third, and fourth quadrants.

6. The organic light emitting diode display device of claim 4, wherein the plurality of pixels comprises a first pixel to emit red light, a second pixel to emit green light, and a third pixel to emit blue light, and the plurality of photodiodes are at a position corresponding to one of a first pixel area corresponding to areas in which red light is to be emitted at some of the pixels, a second pixel area corresponding to areas in which a green light is to be emitted at some of the pixels, and a third pixel area corresponding to areas in which the blue light is to be emitted at some of the pixels.

7. The organic light emitting diode display device of claim 4, wherein the plurality of pixels comprises a first pixel to emit red light, a second pixel to emit green light, and a third pixel to emit blue light, and the plurality of photodiodes are located in the display area without overlapping a first pixel area in which the red light is to be emitted, a second pixel area in which the green light is to be emitted, and a third pixel area in which the blue light is to be emitted.

8. The organic light emitting diode display device of claim 3, further comprising a peripheral area around the display area, wherein the plurality of photodiodes are distributed in the peripheral area.

9. The organic light emitting diode display device of claim 8, wherein the display area comprises four round corners, the peripheral area comprises four peripheral portions adjacent to the four round corners, and the plurality of photodiodes are distributed in the four peripheral portions.

10. The organic light emitting diode display device of claim 1, further comprising a gravity sensor configured to measure a gravity direction to generate a gravity sensing signal indicating a direction toward which the display area is directed, wherein the signal controller is configured to perform the external compensation, by causing the compensation circuit to generate the compensation value, when the direction indicated by the gravity sensing signal coincides with the gravity direction.

11. The organic light emitting diode display device of claim 10, wherein the signal controller is further configured to not perform the external compensation by causing the compensation circuit to not generate the compensation value when the direction indicated by the gravity sensing signal does not coincide with the gravity direction.

12. A driving method of an organic light emitting diode display device, the method comprising:

checking whether external light is detected by a photo-sensor;

receiving a current flowing through a plurality of pixels through a plurality of receiving lines connected to the plurality of pixels when the external light is not detected;

generating a compensation value to compensate for deterioration of a driving transistor in each of the plurality of pixels based on the received current; and performing external compensation to generate an image data signal by applying the compensation value to an image signal received from an external device.

13. The driving method of the organic light emitting diode display device of claim 12, wherein the performing external compensation is not performed by preventing the compensation value from being generated, when external light is recognized by the photo-sensor.

14. The driving method of the organic light emitting diode display device of claim 12, wherein the photo-sensor comprises a plurality of photodiodes configured to convert light energy to electrical energy.

15. The driving method of the organic light emitting diode display device of claim 14, wherein the plurality of photodiodes are distributed in a display area comprising the plurality of pixels.

16. The driving method of the organic light emitting diode display device of claim 15, wherein the plurality of pixels comprises a first pixel to emit red light, a second pixel to emit green light, and a third pixel to emit blue light, and the plurality of photodiodes are at a position corresponding to one of a first pixel area corresponding to areas in which red light is to be emitted at some of the pixels, a second pixel area corresponding to areas in which green light is to be emitted at some of the pixels, and a third pixel area corresponding to areas in which blue light is to be emitted at some of the pixels.

17. The driving method of the organic light emitting diode display device of claim 14, wherein the plurality of photodiodes are distributed in a peripheral area around a display area comprising the plurality of pixels.

18. The driving method of the organic light emitting diode display device of claim 17, wherein the display area comprises four round corners, the peripheral area comprises four peripheral portions adjacent to the four round corners, and the plurality of photodiodes are distributed in the four peripheral portions.

19. The driving method of the organic light emitting diode display device of claim 12, further comprising generating a gravity sensing signal indicating a direction to which a screen on which an image is displayed is directed by measuring a gravity direction, wherein the performing external compensation is performed when the external light is not recognized and when a direction indicated by the gravity sensing signal coincides with the gravity direction.

20. The driving method of the organic light emitting diode display device of claim 19, wherein the performing external compensation is not performed by preventing the compensation value from being generated, when the direction indicated by the gravity sensing signal does not coincide with the gravity direction.

* * * * *